United States Patent [19]

Hasegawa

[11] 4,304,247

[45] Dec. 8, 1981

[54] DIFFERENTIAL SPEED COIN SORTER

[75] Inventor: Kaiichi Hasegawa, Kawasaki, Japan

[73] Assignee: Billcon Corporation of America, Compton, Calif.

[21] Appl. No.: 129,633

[22] Filed: Mar. 12, 1980

[51] Int. Cl.[3] ..... G07D 3/06

[52] U.S. Cl. ..... 133/3 A; 133/3 D; 133/3 H; 221/182

[58] Field of Search ..... 133/3 R, 3 A, 3 D, 3 E, 133/3 G, 3 H; 221/182, 167, 169

[56] References Cited

U.S. PATENT DOCUMENTS

| | | | |
|---|---|---|---|
| 1,749,421 | 3/1930 | Donnellan | 133/3 E |
| 1,893,828 | 1/1933 | Graeme | 133/3 G |
| 1,947,456 | 2/1934 | Bock | 133/3 G |
| 1,979,659 | 11/1934 | Zierick | 133/3 A |

*Primary Examiner*—F. J. Bartuska

*Attorney, Agent, or Firm*—Bruce L. Birchard

[57] ABSTRACT

By utilizing first and second spaced, joined, co-axial disks with coin-receiving peripheral openings, such disks being separated from each other in the region of said peripheral openings by a fixed ring member having an opening therethrough to permit the passage of coins from the peripheral openings in said first disk to the peripheral openings in said second disk, said first and second disks rotating in unison at a first speed, and a third co-axial disk rotating at a higher speed than said first and second disks and positioned parallel to and adjacent to the second disk whereby coins falling in the peripheral openings of said second disk are urged outwardly by the relative motion of said second and third disks, to contact a rim member having openings of graduated width therethrough corresponding to the diameters of different coins; those different coins may be effectively and accurately separated or sorted into respective types or denominations.

10 Claims, 9 Drawing Figures

DIFFERENTIAL SPEED COIN SORTER

BACKGROUND OF THE INVENTION

1. Field of the Invention

This invention relates to the field of coin sorters and counters.

2. Prior Art

There are many types of coin sorters extant today. In general they rely on moving coins along a surface such as a rail, and separating the various sized coins by holes or slots of different widths corresponding to the various diameters of coins to be sorted. One of the common problems of prior art coin sorters has been that smaller coins erroneously appear in the bins of larger coins. This phenomenon results from the fact that coins sometimes have sticky substances on their surfaces and are thus retained by the pickup means beyond the hole or slot through which they should fall to be properly sorted. Coins also bounce while being moved in prior art machines and sometimes skip over their proper exit openings.

Therefore, it is an object of this invention to provide a coin sorter which is free of the general problems set forth hereinbefore.

It is a further object of the invention to provide a coin sorter which accurately and consistently sorts coins of different sizes at high speeds.

BRIEF DESCRIPTION OF THE DRAWINGS

The nature of this invention can best be understood by referring to the description which follows taken in conjunction with the drawings, in which.

DETAILED DESCRIPTION OF THE PREFERRED EMBODIMENT

Figure 1:
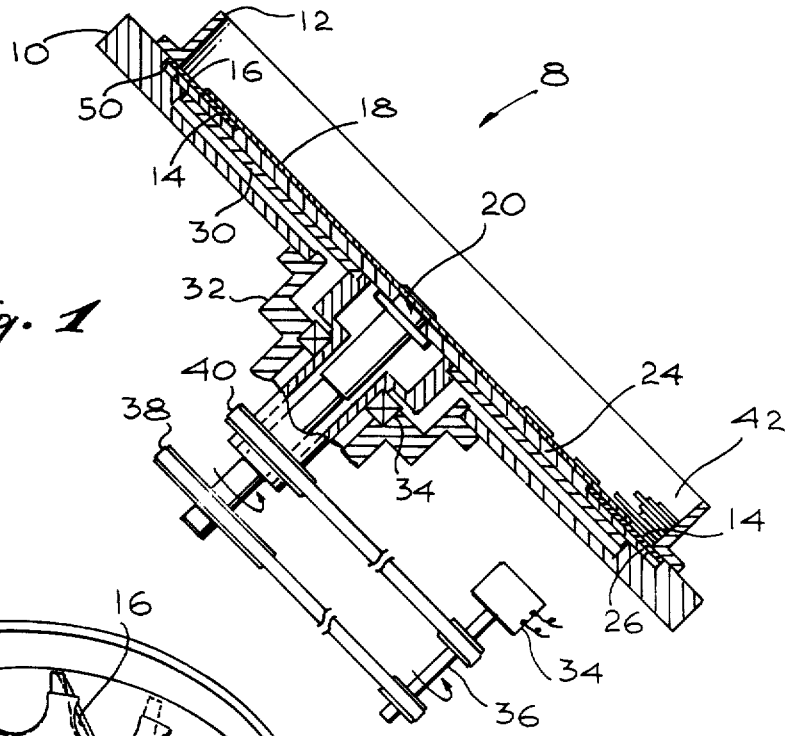
FIG. 1 is a partially cross-sectioned and partially schematic view of a coin sorter according to the present invention.
Figure 2:
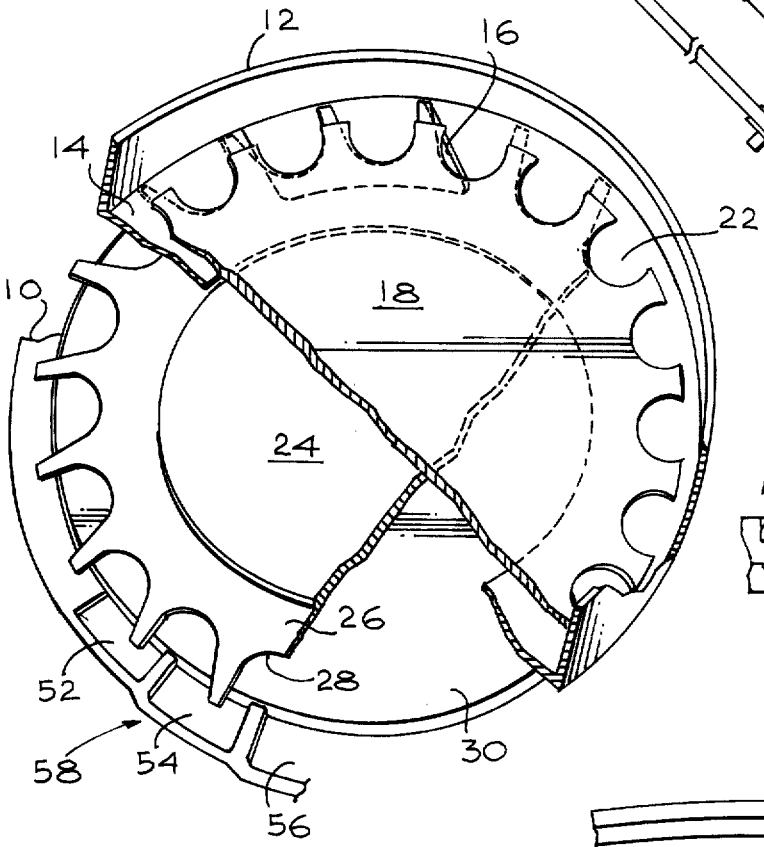
FIG. 2 is an elevation view, partially cut away, of the coin sorter of FIG. 1.

In FIG. 1, body 10 carries stationary ring 12 having apron 14 affixed thereto. Apron 14 has an opening 16 therein which can be seen more clearly in FIGS. 2 and 3. Pickup plate 18 is disk-shaped and is carried concentrically on shaft 20. As can be seen more clearly in FIG. 2, pickup plate 18 has arcuate openings 22 along its outer edge to form pockets to receive coins. Spider 24 is affixed to pickup plate 18 and rotates therewith upon rotation of shaft 20. Spider 24 has a section, 26, of reduced thickness which passes under apron 14 during rotation of pickup plate 18 and spider 24. Section 26 has arcuate pockets along its periphery to receive coins which are picked up by the pickup plate 18 and fall through opening 16 in stationary plate apron 14. These arcuate shaped pockets 28 can be seen more clearly in FIGS. 2, 3, 5, 6, and 8. Spider plate 24 is coaxial with pickup plate 18.

A third disk 30, which is coaxial with pickup plate 18 and spider 24, is provided contiguous with spider plate 24, particularly in the region of reduced section 26 having arcuate openings 28 therein. Disk 30 forms a moving bottom for the arcuate sections or pockets 28 in reduced thickness section 26 of spider 24. Disk 30 is supported in gearbox 32 by bearing 34 so as to be rotatable about the axis of shaft 20 but independently thereof. In other words, it is possible to have disk 30 rotate at a speed higher than the speed of spider 24. The results of this differential in rotational speed between disk 30 and spider 24 will be discussed in more detail later, but basically it effects a stripping of any sticky coins from spider 24 and urges such coins to the outer rim or wall 50 of coin sorter 8.

The separating mechanism of coin sorter 8 is supported in a tilted fashion as shown in FIG. 1 with coins being deposited in the lower portion or reservoir 42.

In operation, coins placed in reservoir 42 are picked up individually by pockets 22 in pickup plate 18 and are moved upwardly until they reach slot 16 in apron 14 associated with stationary ring 12.

Figure 4:
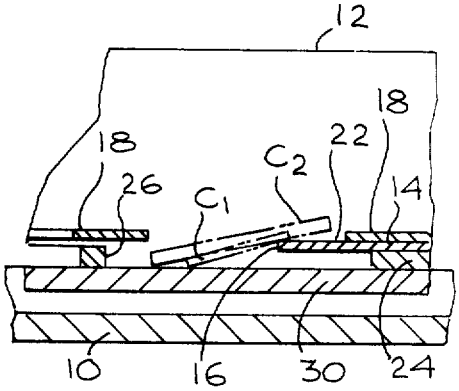
FIG. 4 is a schematic view showing the positioning of coins being sorted in the invention of FIG. 1.
Figure 3:
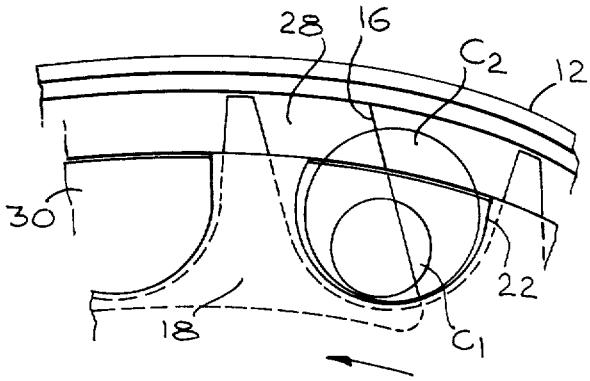
FIG. 3 is a view of a portion of the coin sorter of FIG. 1 showing the relationship of certain of the operating elements of this invention.
Figure 5:
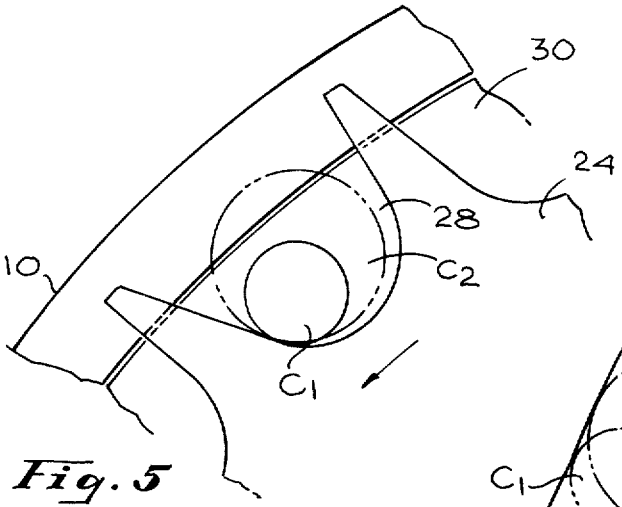
FIG. 5 is a schematic view of an advanced step in the coin sorting operation of the invention of FIG. 1.
Figure 6:
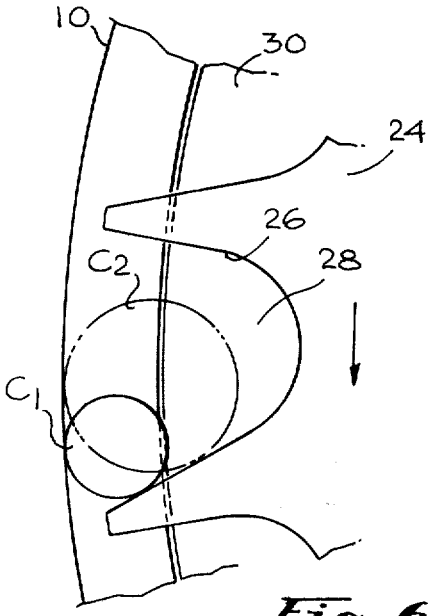
FIG. 6 is a schematic representation of a further state in the sorting operation of the invention of FIG. 1.

As can be seen from FIGS. 3 and 4, one of the first steps in the sorting of the coins is to move the coins from being in the control of pickup plate 18 into the control of spider 24. That step is achieved as coins are moved upwardly by pockets 22 in pickup plate 18. Near the uppermost portion of apron 14 in stationary ring 12 there is the slot or opening 16 which is of sufficient width to pass as large a diameter coin as it is expected will be sorted and which has a length which is several multiples of the diameter of the coins being sorted so as to assure that they fall through this slot 16 and into the control of spider 24, particularly in the region of reduced width, 26, which has arcuate pockets 28. The floor, or bottom, of pockets 28 is formed, at least in part, by disk 30 which is rotating at a speed different from the speed at which spider 24 is rotating and, in one embodiment of the invention, disk 30 rotates at a higher speed than spider 24. As a result, coins falling through slot 16 are first urged away from stationary apron 14 and into the control of spider 24, particularly at its extremity along its periphery where pockets or arcuate openings 28 are provided. After falling into the control of spider 24 and its arcuate openings 28, the coins are urged toward wall 50 by centrifugal force and by the differential rotational speed of disk 30.

In FIGS. 3 through 9, two sizes of coins illustrated, one designated $C_1$ and the other, the larger coin, being indicated in broken lines, by the designation $C_2$. The purpose of the showning of the two sized coins is to show the separation or sorting process more clearly.

As the coins fall into the control of spider 24 they are caused to move along wall 50 and are urged against it, as indicated, by centrifugal force and the motion of disk 30 relative to spider 24. This phenomenon can be seen more clearly in FIGS. 6 and 7. As a coin completes a cycle of motion from its being picked up by pickup plate 18, falling through opening 16 into the control of spider 24 and urged by centrifugal force and the relative motion between spider 24 and disk 30 toward shoulder 50 in body portion 10, each coin encounters a series of openings, such as openings 52, 54, and 56 in sorting section 58 of body 10. These openings are of stepped width so as to respond to the various sizes of coins for which sorting is to be done.

Figure 8:
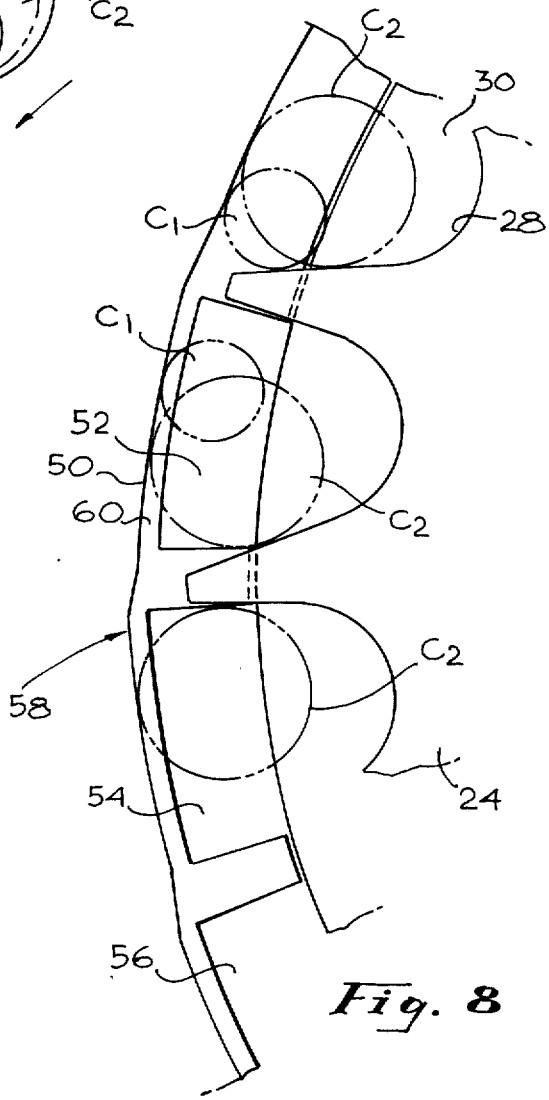
FIG. 8 is a schematic representation of the coin sorting operation within the invention of FIG. 1.
Figure 7:
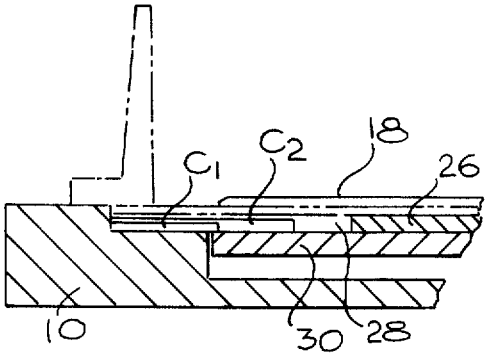
FIG. 7 is a cross-sectional view showing the relative positioning of coins being sorted during a portion of the sorting cycle of the invention of FIG. 1.
Figure 9:
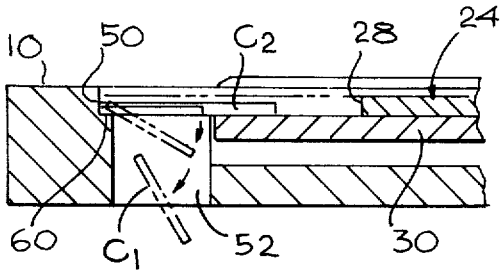
FIG. 9 is a partially cross-sectional and partially schematic representation of the fashion in which coins are finally separated or sorted in the invention of FIG. 1.

An enlarged view of sorting section 58 is shown in FIG. 8 and its effects are shown in FIG. 9. By reason of centrifugal force and the action of disk 30 and its rotating at a higher speed than spider 24 the coins, such as coins $C_1$ and $C_2$ in FIG. 8, are urged toward wall 50 and ride along that wall as they are moved about the sorter. As can be seen from FIG. 8 or 9, the width of the openings 52, 54, and 56 step up in the direction of motion of the coins as produced by spider 24. As a result, the coins of smallest diameter, for example, the United States dime, first fall through the appropriately sized opening 52 into the bin provided for such coins below the opening. The position of this opening can be seen with greater clarity in FIG. 9. As a coin moves into the slot of related size, it falls off shoulder 60 on which it has been riding, being urged against wall 50. It falls through the appropriate opening such as opening 52 into an appropriate receptacle or bin placed below it. At the same time the larger coin, for example, a quarter, continues to rest on shoulder 60 and disk 30 until it moves over the appropriate sized opening, for example, opening 56 in FIG. 8, at which time it falls off shoulder 60 and through the related opening 56 in body 10 and into a container or bin set below that opening but not shown in the drawings. The relative rotation between spider 28 and disk 30 assures that even though a coin, such as coin $C_1$ or coin $C_2$, has foreign matter on it, for example, gum or other sticky material, it will be peeled loose, first from pickup plate 18 so that it will fall through opening 16, and second it will be peeled loose from spider 24 so as to be assured of falling through the appwopriate slot into the sorting bin or receptacle.

FIG. 9 shows symbolically the ability of hole or space 52 to discriminate between coins of different sizes and hence to sort the coins. As can be seen, the larger coin $C_2$ does not fall through hole 52, whereas the smaller coin $C_1$ does fall through the hole or slot in body 10 and will be caught by the appropriate bin below it, not shown here. The major problem encountered with previous sorters, namely, that of the smaller coin sticking to the driving mechanism, such as spider 24 and thus moving on to a larger and improper exit aperture, is avoided by reason of the addition of the disk 30 moving at a speed which is different from a speed of spider 24, and in this embodiment greater, so as to urge the separation of the coin from the driving spider 24.

While a particular embodiment of this invention has been shown and described, it should be apparent to those skilled in the art that variations and modifications may be made in this embodiment while still remaining within the spirit and scope of this invention. It is the purpose of the appended claims to cover all such modifications and alterations.

What is claimed is:

1. A coin sorter, including:

a body;

a stationary coin-receiving means supported from said body;

a shaft supported rotatably in said body;

a coin pickup disk supported coaxially on said shaft, having first coin pockets along its periphery and having upper and lower surfaces, said shaft being positioned to cause said first coin pockets to pass through said coin-receiving means, said first coin pockets being sized to pick up individual ones of the coins in said coin-receiving means;

a stationary, ring-shaped apron having upper and lower surfaces and supported from said said body coaxially with said shaft and adjacent to said pickup disk along the lower surface thereof;

a circular spider having upper and lower surfaces and supported from said shaft coaxially with said coin pickup disk and adjacent the lower surface of said apron, said spider having openings along its periphery;

a differential disk supported coaxially with said shaft and in relative rotational relationship therewith, said differential disk being adjacent said lower surface of said spider;

said apron having an opening therethrough of width and length than the diameter of the largest of the coins to be sorted, whereby coins upon reaching said opening under the motivation of said pickup disk fall through said opening in sequence and are engaged by said spider on the edges of said coins and by said differential disk on one face of each thereof;

coin-size discriminating means supported in proximity to the periphery of said differential disk, said discriminating means including exit apertures of respective widths and lengths related to the diameters of the respective coin types to be sorted; and driving means for driving said spider and said differential disks at different relative rotational speeds.

2. Apparatus according to claim 1 in which said shaft and said body are tilted with respect to the horizon in normal operations.

3. Apparatus according to claim 1 in which said coin pickup disk is secured to said spider.

4. Apparatus according to claim 2 in which said opening in said apron is located near the uppermost portion of said body.

5. Apparatus according to claim 2 in which said coin-receiving means are located near the lowermost portion of said body.

6. Apparatus according to claim 2 in which said coin-size discriminating means are located near the lowermost portion of said body.

7. Apparatus according to claim 1 which includes, in addition, a gear box supported from said body and including bearing means for permitting relative motion between said differential disk and said spider.

8. Apparatus according to claim 1 in which said pockets in said coin pickup disk are arcuate in shape.

9. Apparatus according to claim 1 in which said body includes shoulder means onto which coins being sorted are forced by the centrifugal forces derived from the action of said spider and by the wiping action of said differential disk.

10. Apparatus according to claim 1 in which said differential disk moves at a higher rotational speed than said spider.

* * * * *